US009138773B1

(12) United States Patent
Brooks

(10) Patent No.: US 9,138,773 B1
(45) Date of Patent: Sep. 22, 2015

(54) TERRY CLOTH WITH IMPREGNATED RUBBER SUBSTRATE AND TOOL FOR APPLICATION THEREON

(76) Inventor: Lawrence Brooks, Port Townsend, WA (US)

( * ) Notice: Subject to any disclaimer, the term of this patent is extended or adjusted under 35 U.S.C. 154(b) by 522 days.

(21) Appl. No.: 13/568,225

(22) Filed: Aug. 7, 2012

(51) Int. Cl.
*B43M 11/02* (2006.01)
*B05C 17/02* (2006.01)

(52) U.S. Cl.
CPC ..... *B05C 17/0207* (2013.01); *B05C 17/021* (2013.01); *B05C 17/02* (2013.01)

(58) Field of Classification Search
CPC .... B05C 17/02; B05C 17/021; B05C 17/0207
USPC ..... 401/218–220; 15/230.11; 118/428.06, 118/211, DIG. 15; 429/17, 19, 30
See application file for complete search history.

(56) References Cited

U.S. PATENT DOCUMENTS 4,788,733 A 12/1988 Lerner
5,060,943 A 10/1991 Stoffo
5,497,556 A * 3/1996 Lebessis ..... 30/365
5,643,403 A * 7/1997 Poole et al. ..... 156/762
6,669,612 B2 * 12/2003 Jager ..... 492/30
D600,487 S 9/2009 Franco
2005/0192158 A1 9/2005 Edwards
2006/0288477 A1 12/2006 Kerley
2008/0104807 A1 5/2008 Hosfeld

* cited by examiner

*Primary Examiner* — Jennifer C Chiang
(74) *Attorney, Agent, or Firm* — Kyle A. Fletcher, Esq.

(57) ABSTRACT

The terry cloth with impregnated rubber substrate and tool for application thereon includes a roller having a plurality of spur members equally spaced thereon, and which are ideal in distribution of a rubber solution into the individual loops of a terry cloth. The formation of a rubber substrate into the individual loops of a terry cloth provides for traction of said terry cloth upon smooth surfaces. The spur members are discs that have a plurality of fingers that extend laterally to opposing sides, which manages and spreads a rubber solution into the individual loops of a single side of the terry cloth. Moreover, the tool does not saturate the rubber solution through the base and the opposing side of loops of said terry cloth. Upon application of the rubber solution onto the side of the terry cloth, the individual loops are vertically orientated and individually coated.

11 Claims, 7 Drawing Sheets

TERRY CLOTH WITH IMPREGNATED RUBBER SUBSTRATE AND TOOL FOR APPLICATION THEREON

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of towels and fabrics, more specifically, a terry cloth fabric that has been impregnated with a rubber substrate on a single side in order to provide traction upon smooth surfaces.

Terry cloth-styled fabrics are ideal for drying moisture from a surface, whether it is skin or some other material. Moreover, terry cloths are commonly used in beach towels or bath towels in order to dry off an end user as needed. However, a terry cloth can pose a hazard when placed upon a smooth surface. This is especially true when lying a terry cloth upon a fiberglass surface of a boat. Often, the terry cloth will slide when lying upon said smooth surface, which can result in slippage to an end user.

There have been many attempts to treat terry cloth type fabrics with a rubber treatment in order to provide traction when placed upon smooth surfaces. However, these attempts often lack a terry cloth that has a rubber solution impregnated on only one side of the terry cloth. Moreover, treating a terry cloth with a rubber solution often leaves the individual loops flattened and essentially encased within a thick layer of rubber. The method of application and tool used of the present application seeks to overcome the shortcomings of rubber-coated terry cloths of yore.

B. Discussion of the Prior Art

As will be discussed immediately below, no prior art discloses a terry cloth-styled towel that has been impregnated with a rubber substrate upon a side via a tool and method of application, which provides the towel with a slip-free texture that is ideal for use with smooth surfaces; wherein the tool is a roller that has a plurality of spur members that are equally spaced along said roller; wherein each spur member is further defined as a disc with a plurality of fingers that extend laterally to opposing sides of the spur member; wherein the spur members are ideal for applying a liquid rubber solution of certain viscosity into the terry cloth-styled towel such that the individual loops comprising the terry cloth-styled towel are vertically oriented and coated with the rubber substrate without saturating the base of the terry cloth.

The Stoffo Patent (U.S. Pat. No. 5,060,943) discloses a fabric member impregnated with non-slip material that is attached in layered fashion to a terry-cloth towel. However, the fabric member is not treated with a liquid rubber forming a rubber substrate via a tool and method of application provided therein.

The Edwards Patent Application Publication (U.S. Pub. No. 2005/0192158) discloses a yoga mat made from fibers embedded with rubber. However, the yoga mat is not treated with a rubber solution via a tool and method of application forming a rubber substrate.

The Kerley Patent Application Publication (U.S. Pub. No. 2006/0288477) discloses a foot towel consisting of a base portion that is made of rubber and a top portion, which is a towel. However, the towel is not coated with a rubber substrate via the method and tool of the present application.

The Lerner Patent (U.S. Pat. No. 4,788,733) discloses a rubber glove having a towel on the palmer surface. Again, there is no tool specific to application of a rubber solution onto a terry-cloth styled fabric or towel that generates the rubber substrate therein.

The Hosfeld Patent Application Publication (U.S. Pub. No. 2008/0104807) discloses a towel for use on the deck of a boat. Again, there is no tool specific to application of a rubber solution onto a terry-cloth styled fabric or towel that generates the rubber substrate therein.

The France Patent (U.S. Patent No. Des. 600,487) illustrates an ornamental design for a beach towel, which does not teach a tool for application of a rubber solution into the individual loops comprising a terry-cloth styled fabric or towel.

While the above-described devices fulfill their respective and particular objects and requirements, they do not describe a terry cloth-styled towel that has been impregnated with a rubber substrate upon a side via a tool and method of application, which provides the towel with a slip-free texture that is ideal for use with smooth surfaces; wherein the tool is a roller that has a plurality of spur members that are equally spaced along said roller; wherein each spur member is further defined as a disc with a plurality of fingers that extend laterally to opposing sides of the spur member; wherein the spur members are ideal for applying a liquid rubber solution of certain viscosity into the terry cloth-styled towel such that the individual loops comprising the terry cloth-styled towel are vertically oriented and coated with the rubber substrate without saturating the base of the terry cloth. In this regard, the terry cloth with impregnated rubber substrate and tool for application thereon departs from the conventional concepts and designs of the prior art.

SUMMARY OF THE INVENTION

The terry cloth with impregnated rubber substrate and tool for application thereon includes a roller having a plurality of spur members equally spaced thereon, and which are ideal in distribution of a rubber solution into the individual loops of a terry cloth. The formation of a rubber substrate into the individual loops of a terry cloth provides for traction of said terry cloth upon smooth surfaces. The spur members are discs that have a plurality of fingers that extend laterally to opposing sides, which manages and spreads a rubber solution into the individual loops of a single side of the terry cloth. Moreover, the tool does not saturate the rubber solution through the base and the opposing side of loops of said terry cloth. Upon application of the rubber solution onto the side of the terry cloth, the individual loops are vertically orientated and individually coated.

An object of the invention is to provide a terry cloth type fabric in which a single side is treated with a rubber solution such that the individual loops of the terry cloth remain vertically oriented while being individually coated with a rubber substrate such that the terry cloth has traction when placed upon a smooth surface while leaving the opposing surface side up for use in drying moisture as needed.

A further object of the invention is to provide a tool and method of application that produces the desired rubber substrate onto the side of the terry cloth.

An even further object of the invention is to provide a tool that manages rubber solutions having relatively high viscosities such that the rubber solution is evenly spread across and in between the individual loops of the side of the terry cloth fabric.

An object of the invention is to provide a tool that does not saturate the rubber solution into the base and opposing side of the terry cloth, but rather draws in between the individual loops of the desired side of the terry cloth and subsequently drawing excess rubber solution away.

Another object of the invention is to provide a tool that is a roller having a plurality of spur members equally spaced along a length of the roller, and which manage and distribute the rubber solution into the individual loops along the first side of the terry cloth fabric.

An even further object of the invention is to provide a spur member that is further as a disc member having a plurality of fingers that extend laterally from opposing sides of the spur member.

An even further object of the invention is to equally space the plurality of fingers along the circumference of the spur member, and which engage individual loops of the terry cloth fabric in order to distribute and coat the rubber solution thereon.

These together with additional objects, features and advantages of the terry cloth with impregnated rubber substrate and tool for application thereon will be readily apparent to those of ordinary skill in the art upon reading the following detailed description of presently preferred, but nonetheless illustrative, embodiments of the terry cloth with impregnated rubber substrate and tool for application thereon when taken in conjunction with the accompanying drawings.

In this respect, before explaining the current embodiments of the terry cloth with impregnated rubber substrate and tool for application thereon in detail, it is to be understood that the terry cloth with impregnated rubber substrate and tool for application thereon is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the terry cloth with impregnated rubber substrate and tool for application thereon.

It is therefore important that the claims be regarded as including such equivalent construction insofar as they do not depart from the spirit and scope of the terry cloth with impregnated rubber substrate and tool for application thereon. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. A terry cloth with impregnated rubber substrate 100 (hereinafter invention) includes a tool 101 and a rubber solution 102.

Figure 6:
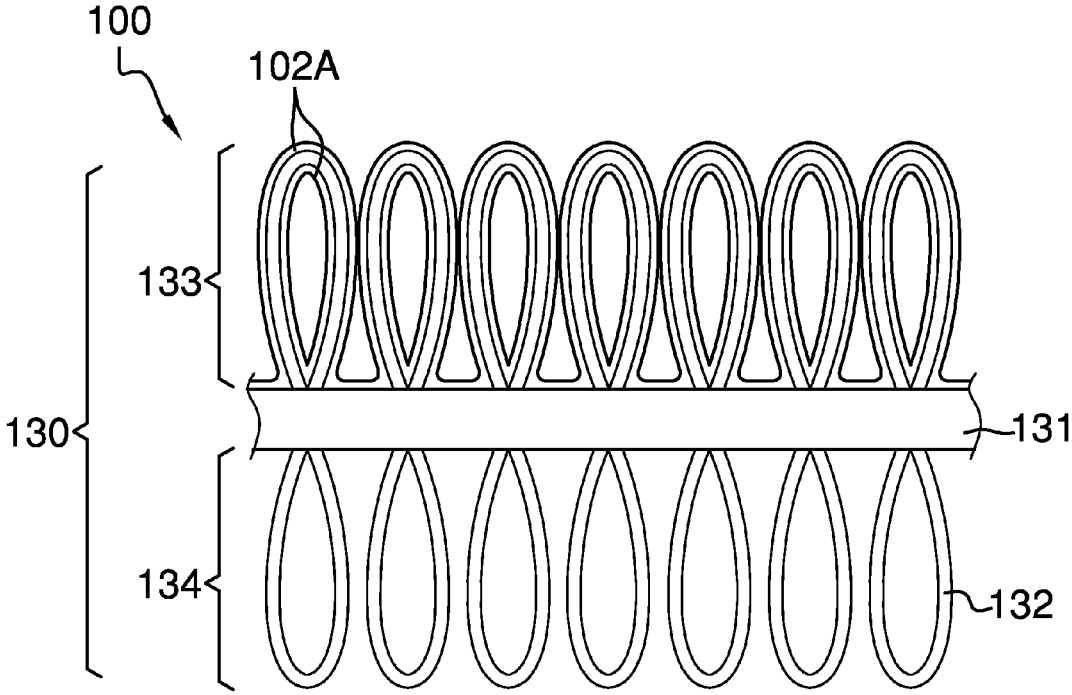
FIG. 6 illustrates a cross-sectional view along line 6-6 in FIG. 5, and detailing the rubber substrate installed onto the first side of the terry cloth with detail pertaining to the vertical orientation and individualized coating of each of the individual loops comprising the first side.

Prior to discussion of the invention 100 and process of manufacture, a terry cloth-type fabric 130 (hereinafter terry cloth) is used in connection therewith. Referring to FIG. 6, the construction of the terry cloth 130 is comprised of a base fabric 131 into which individual loops 132 are vertically extended from a first side 133 and a second side 134. More specifically, both sides of the terry cloth 130 are essentially covered in the individual loops 132.

The rubber solution 102 is a liquid that when applied to the terry cloth 130 in an open air environment shall dry forming a solid rubber that essentially coats the individual loops 132. The rubber solution 102 in liquid form has a relatively high viscosity, which can be messy when handling. The tool 101 of the invention 100 is specifically designed for use in handling the rubber solution 102 on terry cloths 130.

The tool 101 resembles a modified paint roller that includes an arm 101A that supports a plurality of spur members 101B, which are equally separated at a predefined length 101C. The spur members 101B are arranged throughout to form a pattern on the arm 101A.

Each spur member 101B is constructed of at least one disc member 151 of an undefined diameter. The disc members 151 each include spurs 152 that are equally spaced along the circumference of the respective disc member 151. Moreover, fingers 153 extend outwardly from the disc member 151. The fingers 153 extend outwardly at each of the spurs 152 provided on the disc member 151. Moreover, two disc members 151 are separated from one another via a disc space 154, and each of the disc members 151 includes fingers 153 that extend away from the disc members 151. The spurs 152 and the fingers 152 are equally spaced and are offset from one another at an angle 101D.

The invention 100 as a process of manufacture begins with pouring the rubber solution 102 onto the first side 133 of the terry cloth 130. It shall be noted that the term "first side" is being used to refer to the side of the terry cloth 130 in which each individual loop 132 is being coated with the rubber solution 102.

Figure 5:
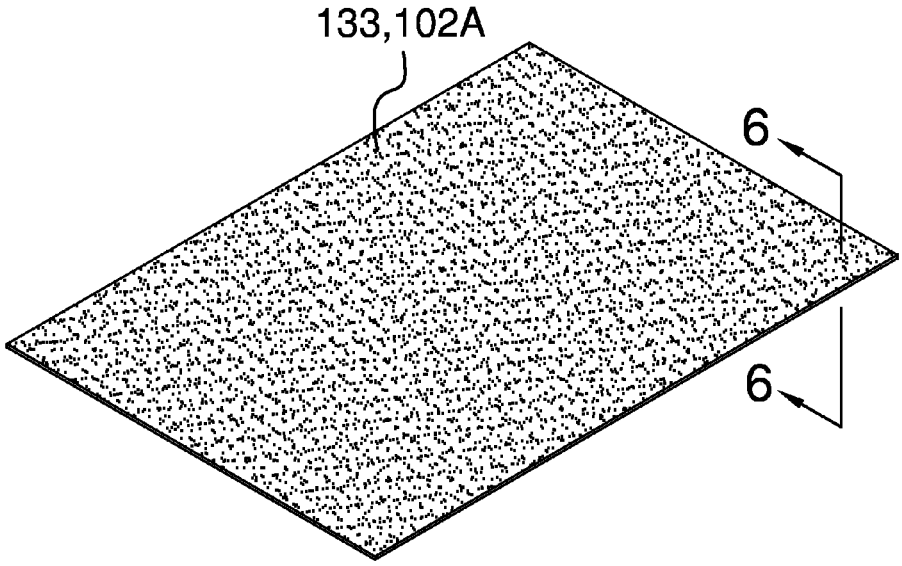
FIG. 5 illustrates a perspective view of the terry cloth after treatment with the rubber substrate to the first side of the terry cloth.

Next the tool 101 spreads the rubber solution 102 across the first surface 133, and into each individual loop 132 in order to coat said individual loop 132 with the rubber solution 102. Next, the terry cloth 130 and the rubber solution 102 are left to dry, and after a predefined amount of time shall result in a rubber substrate 102A as depicted in FIGS. 5-6.

Figure 1:
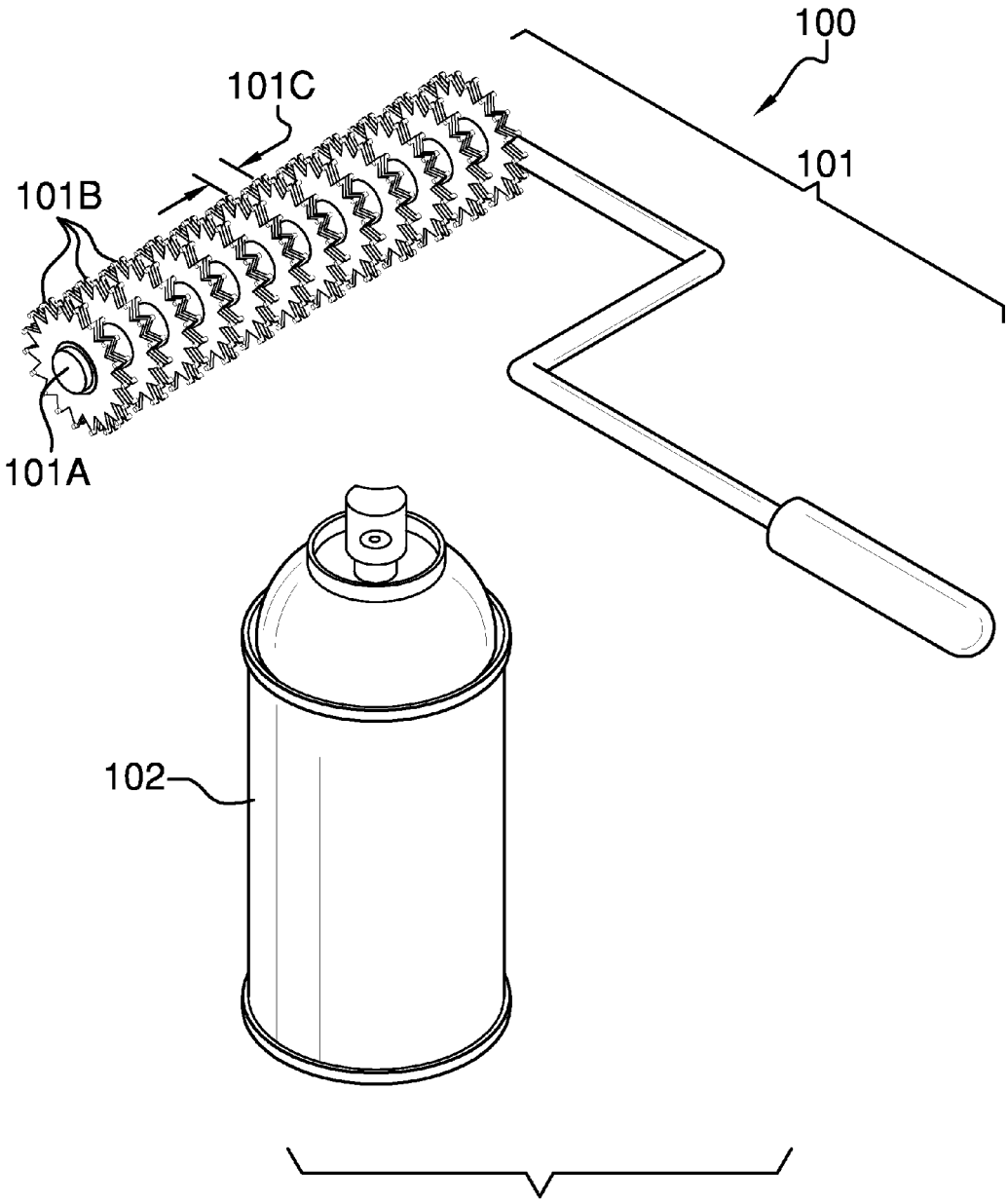
FIG. 1 illustrates a view of the tool and a bottle containing the rubber solution that is used to treat the first side of a terry cloth.
Figure 1A:
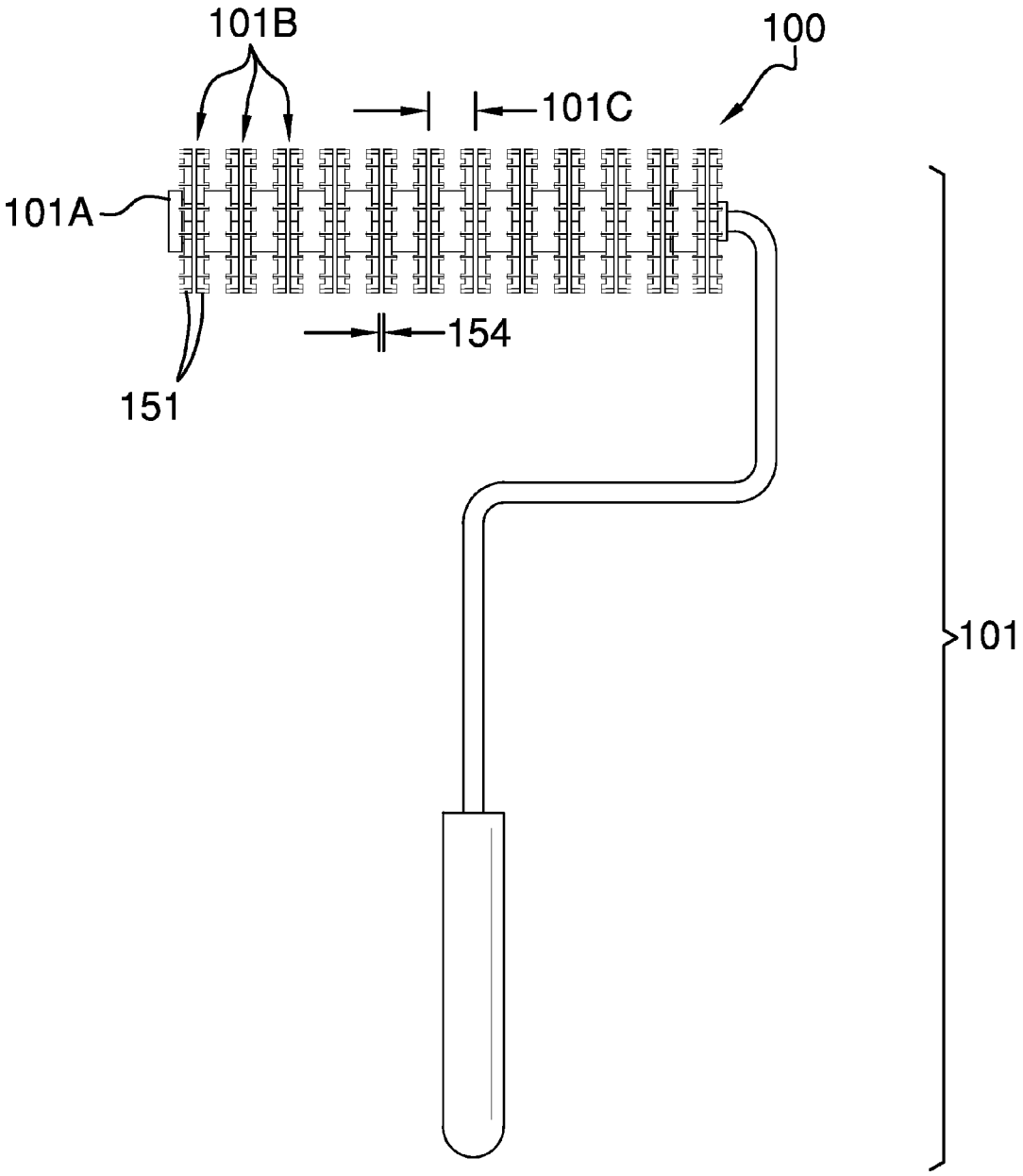
FIG. 1A illustrates a front view of the roller by itself and detailing the individual fingers extending from opposing sides of each spur member.
Figure 2:
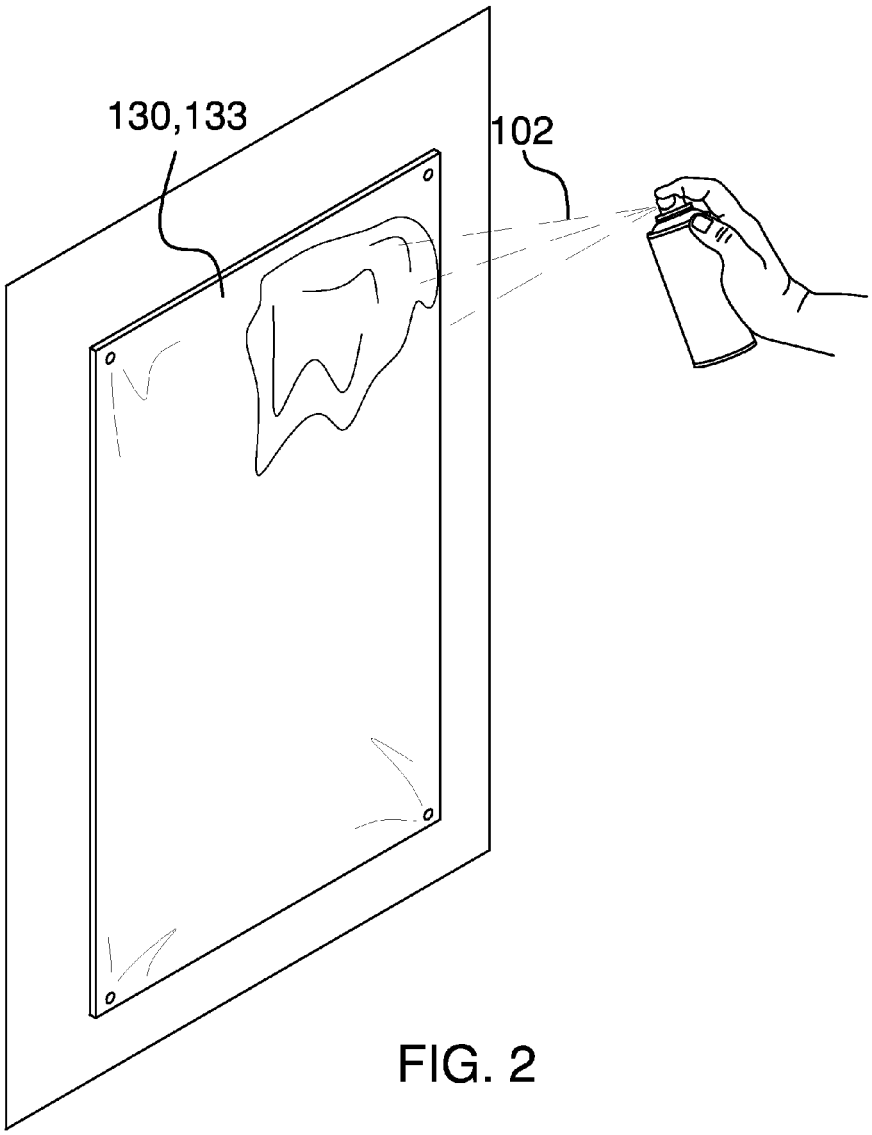
FIG. 2 illustrates a perspective view wherein the rubber solution is sprayed onto a first side of the terry cloth, which is held in place against a vertical wall surface.
Figure 3:
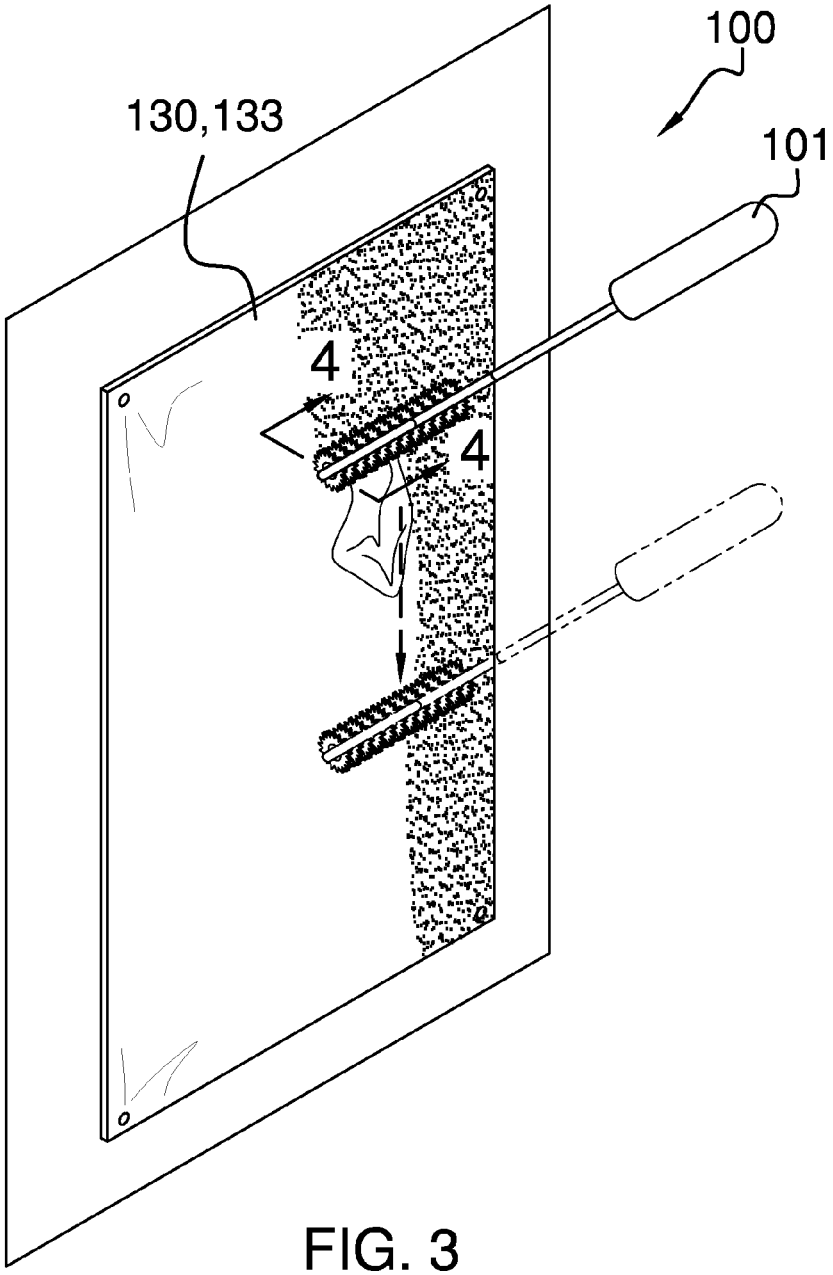
FIG. 3 illustrates a perspective view in which the tool is rolled back and forth atop of the first side in order to distribute the rubber solution into the individual loops comprising the first side of the terry cloth.
Figure 4:
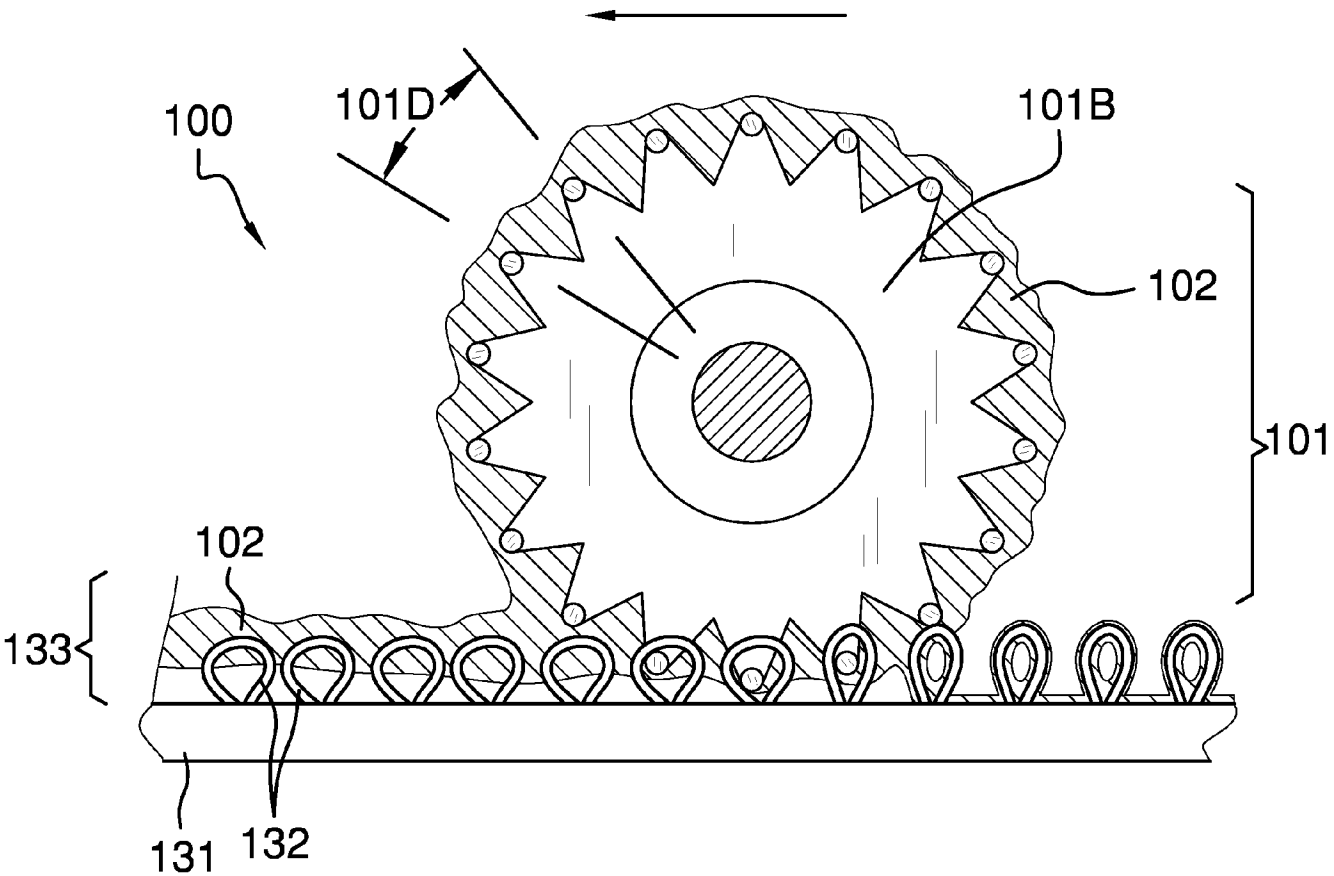
FIG. 4 illustrates a cross-sectional view along line 4-4 in FIG. 3, and detailing the process performed when the roller is rolled atop of the first side and along the individual loops forming said first side, and while depicting the impregnation of the rubber solution into each individual loop via the fingers of each spur member.
Figure 4A:
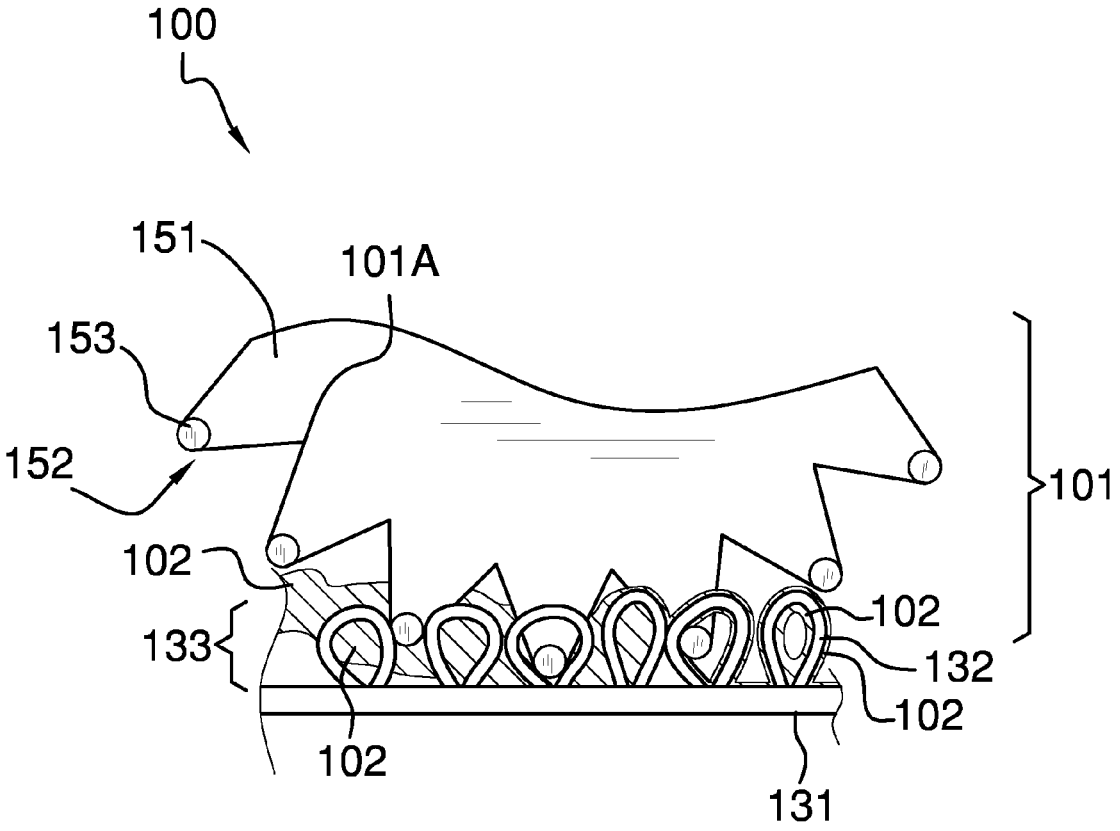
FIG. 4A illustrates a close-up view of FIG. 4, and further detailing the penetration of rubber solution when flattening one of the individual loops and subsequent lifting and elongation of an adjacent individual loop that remains vertically oriented and coated in the rubber solution.

Referring to FIGS. 4 and 4A, the fingers 153 of the tool 101 accomplish a series of tasks, which are important to the finished product. Firstly, the fingers 153 push the rubber solution 102 and the individual loops 132 downward in order for the respective individual loop 132 to be saturated with the rubber solution 102. Secondly, after the fingers 153 pass over the respective individual loop 132, excess rubber solution 102 is drawn away from the first side 133, and during which the respective individual loop 132 is pulled upwardly into a vertical orientation, and left thereafter to dry with the rubber solution 102 thereon.

It shall be noted that the surface tension of the rubber solution 102 in conjunction with the spacing of the fingers 153 are responsible for drawing away excess rubber solution 102 from the first side 133.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A tool for impregnating a first side of a terry cloth with a rubber solution comprising:

a roller that includes an arm that supports a plurality of spur members, which are equally separated at a predefined length; wherein the spur members are arranged throughout to form a pattern on the arm;

wherein the spur members of the tool saturate and impregnate individual loops of a first side of said terry cloth with a rubber solution when said tool is rolled back and forth against said terry cloth;

wherein said tool prevents said rubber solution from saturation through a base of said terry cloth and into a second side of said terry cloth;

wherein the spur members each include fingers that extend outwardly therefrom, and push the rubber solution and the individual loops downward in order for the respective individual loop to be saturated with the rubber solution; and wherein each spur member is constructed of at least one disc member of an undefined diameter; wherein each disc member includes spurs that are equally spaced along the circumference of the respective disc member.

2. The tool as described in claim 1 wherein fingers extend outwardly at each of the spurs provided on the disc member.

3. The tool as described in claim 2 wherein each spur member is constructed of two disc members are separated from one another via a disc space, and each of the disc members includes fingers that extend away from the two disc members.

4. The tool as described in claim 3 wherein the spurs and the fingers of each disc member are equally spaced and are offset from one another at an angle.

5. A tool for impregnating a first side of a terry cloth with a rubber solution comprising:

a roller that includes an arm that supports a plurality of spur members, which are equally separated at a predefined length; wherein the spur members are arranged throughout to form a pattern on the arm;

wherein the spur members of the tool saturate and impregnate individual loops of a first side of said terry cloth with a rubber solution when said tool is rolled back and forth against said terry cloth; and wherein said tool prevents said rubber solution from saturation through a base of said terry cloth and into a second side of said terry cloth;

wherein the spur members each include fingers that extend outwardly therefrom, and push the rubber solution and the individual loops downward in order for the respective individual loop to be saturated with the rubber solution; and wherein each spur member is constructed of at least one disc member of an undefined diameter; wherein each disc member includes spurs that are equally spaced along the circumference of the respective disc member.

6. The tool as described in claim 5 wherein fingers extend outwardly at each of the spurs provided on the disc member.

7. The tool as described in claim 6 wherein each spur member is constructed of two disc members are separated from one another via a disc space, and each of the disc members includes fingers that extend away from the two disc members.

8. The tool as described in claim 7 wherein the spurs and the fingers of each disc member are equally spaced and are offset from one another at an angle.

9. A tool for impregnating a first side of a terry cloth with a rubber solution comprising:

a roller that includes an arm that supports a plurality of spur members, which are equally separated at a predefined length; wherein the spur members are arranged throughout to form a pattern on the arm;

wherein the spur members of the tool saturate and impregnate individual loops of a first side of said terry cloth with a rubber solution when said tool is rolled back and forth against said terry cloth; and wherein said tool prevents said rubber solution from saturation through a base of said terry cloth and into a second side of said terry cloth;

wherein the spur members each include fingers that extend outwardly therefrom, and push the rubber solution and the individual loops downward in order for the respective individual loop to be saturated with the rubber solution;

whereupon a predefined amount of time shall elapse upon which said rubber solution shall dry forming a rubber substrate into the individual loops of said first side;

wherein each spur member is constructed of at least one disc member of an undefined diameter; wherein each disc member includes spurs that are equally spaced along the circumference of the respective disc member; and wherein fingers extend outwardly at each of the spurs provided on the disc member.

10. The process as described in claim 9 wherein each spur member is constructed of two disc members are separated from one another via a disc space, and each of the disc members includes fingers that extend away from the two disc members.

11. The process as described in claim 10 wherein the spurs and the fingers of each disc member are equally spaced and are offset from one another at an angle.

* * * * *